US010309068B2

(12) United States Patent
Hemann et al.

(10) Patent No.: US 10,309,068 B2
(45) Date of Patent: Jun. 4, 2019

(54) PREFABRICATED BRIDGE INCLUDING STEEL ABUTMENTS

(71) Applicant: Contech Engineered Solutions LLC, West Chester, OH (US)

(72) Inventors: Michael J. Hemann, Alexandria, MN (US); Jarred M. Watts, Munford, AL (US); Gregory H. May, Hixson, TX (US)

(73) Assignee: CONTECH ENGINEERED SOLUTIONS LLC, West Chester, OH (US)

( * ) Notice: Subject to any disclaimer, the term of this patent is extended or adjusted under 35 U.S.C. 154(b) by 58 days.

(21) Appl. No.: 15/614,741

(22) Filed: Jun. 6, 2017

(65) Prior Publication Data

US 2018/0347125 A1 Dec. 6, 2018

(51) Int. Cl.

| | |
|---|---|
| ***E01D 19/02*** | (2006.01) |
| ***E01D 19/12*** | (2006.01) |
| ***E01D 21/00*** | (2006.01) |

(52) U.S. Cl.

CPC ..... *E01D 19/02* (2013.01); *E01D 19/125* (2013.01); *E01D 21/00* (2013.01)

(58) Field of Classification Search

CPC ..... E01D 19/02; E01D 19/125; E01D 21/06; E01D 21/065; E01D 21/08; E01D 21/00; E01D 6/00; E01D 2101/30; E01D 15/133

See application file for complete search history.

(56) References Cited

U.S. PATENT DOCUMENTS

| | | | | |
|---|---|---|---|---|
| 1,610,585 | A * | 12/1926 | Ramsey | E01D 19/125 52/335 |
| 4,129,917 | A * | 12/1978 | Sivachenko | E01D 2/04 14/6 |
| 5,771,518 | A * | 6/1998 | Roberts | E01D 19/02 14/73.1 |
| 5,987,680 | A * | 11/1999 | Sakaya | E01D 19/125 14/73 |
| 6,412,132 | B1 * | 7/2002 | Majnaric | E01D 19/125 14/77.1 |
| 6,857,156 | B1 * | 2/2005 | Grossman | E01D 19/125 14/73 |

(Continued)

OTHER PUBLICATIONS

Admitted prior art, 1 page.

*Primary Examiner* — Abigail A Risic
(74) *Attorney, Agent, or Firm* — Thompson Hine L.L.P.

(57) ABSTRACT

A supported bridge including a prefabricated bridge including a deck and a plurality of girders. The deck is supported above the plurality of girders. The supported bridge further includes, a first and second abutment extending underneath the plurality girders in a direction transverse to the spanwise direction. The transverse abutments are mounted beneath the plurality of girders. The first steel abutment is located toward a first end of the prefabricated bridge and the second steel abutment is located toward a second end of the prefabricated bridge. Each abutment includes a beam and a bottom plate. The beam includes an upper flange, a lower flange, and a web connecting the upper flange and lower flange. The bottom plate is mounted on a bottom surface of the lower flange and has a width that is at least 1.5 times as great as a width of the lower flange.

16 Claims, 4 Drawing Sheets

(56) References Cited

U.S. PATENT DOCUMENTS

| | | | | |
|---|---|---|---|---|
| 8,474,080 | B2 * | 7/2013 | Kim | E01D 2/02 14/77.1 |
| 8,925,132 | B1 * | 1/2015 | Quinonez | E01D 2/02 14/73 |
| 2004/0074022 | A1 * | 4/2004 | Tokuno | E01D 2/00 14/73 |
| 2005/0050810 | A1 * | 3/2005 | Shimazaki | E01D 19/02 52/167.1 |
| 2006/0272111 | A1 * | 12/2006 | Kim | E01D 19/125 14/73 |
| 2010/0186338 | A1 * | 7/2010 | Rischmueller | E01C 15/00 52/650.3 |
| 2012/0279000 | A1 * | 11/2012 | Kim | E01D 2/02 14/77.1 |
| 2013/0061406 | A1 * | 3/2013 | Southworth | E01D 19/125 14/73 |
| 2013/0205518 | A1 * | 8/2013 | Han | E01D 2/02 14/74.5 |
| 2013/0263392 | A1 * | 10/2013 | Han | E01D 2/02 14/74.5 |
| 2014/0109325 | A1 * | 4/2014 | Han | E01D 2/02 14/73 |
| 2016/0340844 | A1 * | 11/2016 | Revenew | E01D 2/02 |

* cited by examiner

PREFABRICATED BRIDGE INCLUDING STEEL ABUTMENTS

TECHNICAL FIELD

This application relates generally to supported bridges that include abutments, as well as methods of constructing supported bridges including a prefabricated bridge and abutments.

BACKGROUND

Prefabricated bridges are generally associated with reduced installation times, reduced overall costs, and reduced construction times. In many cases, during the construction of prefabricated bridges, the foundation and substructure construction are the most costly and time consuming part. For example, concrete abutments are commonly used to support the ends of prefabricated bridges, and such concrete abutments require sufficient cure time if poured on-site or involve shipping difficulties if precast.

Accordingly, it would be desirable to provide a prefabricated bridge that utilizes a more suitable abutment arrangement.

SUMMARY

In one aspect, provided in this disclosure is a supported bridge. The supported bridge includes a prefabricated bridge including a deck and a plurality girders extending in a spanwise direction along the supported bridge. The deck is supported above the plurality of girders. The supported bridge further includes first and second steel abutments extending underneath the plurality of girders in a direction transverse to the spanwise direction. The first steel abutment is located toward a first end of the prefabricated bridge and the second steel abutment is located toward a second end of the prefabricated bridge. Each abutment includes an I-beam and a bottom plate. The I-beam includes an upper flange, a lower flange, and a web connecting the upper flange and lower flange. The bottom plate is mounted on a bottom surface of the lower flange and has a width that is at least 1.5 times as great as a width of the lower flange.

In some aspects, the girders are I-beam girders. Each I-beam girder has an upper flange, a lower flange, and an interconnecting web. The upper flange of each I-beam girder can support the bridge deck and the bottom flange of each I-beam girder can be supported by the first and second steel abutments.

In certain aspects, in each steel abutment, the bottom plate has a length that is substantially the same as, or greater than, a length of the I-beam.

The abutment can further include a plurality of stiffeners spaced apart along the length of the I-beam, with each stiffener interconnecting the upper flange of the I-beam to the bottom plate. In each steel abutment, the stiffeners can include at least first and second stiffeners at opposite ends of the steel abutments. Further, in each steel abutment, the plurality of stiffeners can include one or more intermediate stiffeners at intermediate points along the length of the I-beam. In certain aspects, each steel abutment includes at least one intermediate stiffener aligned with each girder. In certain aspects, each of the at least one intermediate stiffeners is vertically beneath a connection zone between the girder and the steel abutment.

In some aspects the girders are I-beam girders, and each of the at least one intermediate stiffeners is of substantially planar plate configuration that is aligned with a plane defined by a web of the girder.

In some aspects, each of the first and second steel abutments further includes a keel extending lengthwise along a bottom surface of the bottom plate.

In certain aspects, one or more mount plates are placed between the girders and the upper flanges of the I-beams.

As to each girder, a first end of the girder can be mounted to the first steel abutment by a first connection arrangement and a second end of the girder can be mounted to the second steel abutment by a second connection arrangement. The first connection arrangement can include a first upper mount plate connected to an underside of the girder, a first lower mount plate connected to the upper flange of the first steel abutment, and a plurality of bolts passing through aligned holes of the first upper mount plate and the second lower mount plate. The second connection arrangement can include a second upper mount plate connected to the underside of the girder, a second lower mount plate connected to the upper flange of the second steel abutment, and a plurality of bolts passing through aligned holes of the second upper mount plate and the second lower mount plate. In certain aspects, as to each girder, the first upper mount plate can be welded to the girder and the first lower mount plate can be welded to the upper flange of the first steel abutment. Further, the second upper mount plate can be welded to the girder and the second lower mount plate can be welded to the upper flange of the second steel abutment.

In another aspect, provided herein is a supported bridge that includes a prefabricated bridge including a deck supported by a plurality of steel girders extending in a spanwise direction along the supported bridge, wherein the deck is supported above the plurality of girders. First and second steel abutments extend underneath the plurality of girders in a direction transverse to the spanwise direction, wherein the first steel abutment is located toward a first end of the prefabricated bridge and the second steel abutment is located toward a second end of the prefabricated bridge. Each abutment includes a beam and a bottom plate, the beam including an upper flange, a lower flange, and a web connecting the upper flange and lower flange, wherein the bottom plate is mounted at a bottom surface of the lower flange and has a width that is at least 1.5 times as great as a width of the lower flange. The first steel abutment includes a stiffener toward each end and one or more intermediate stiffeners located at intermediate points along the length of the first steel abutment, wherein at least one intermediate stiffener is vertically beneath a connection zone between one girder and the first steel abutment. The second steel abutment includes a stiffener toward each end and one or more intermediate stiffeners located at intermediate points along the length of the second steel abutment, wherein at least one intermediate stiffener is vertically beneath a connection zone between one girder and the second steel abutment. In yet another aspect, provided herein is a steel abutment. The steel abutment includes a beam including an upper flange, a lower flange, and a web connecting the upper flange, and lower flange. A bottom plate is mounted on a bottom surface of the lower flange and has a width that is at least 1.5 times as great as a width of the lower flange. A plurality of stiffeners are located along a length of the beam, each stiffener arranged transverse to the length of the beam and interconnecting the upper flange and the bottom plate. A keel extends lengthwise along a bottom surface of the bottom plate.

In yet another aspect, provided in herein is a method of constructing a supported bridge. The method includes providing a prefabricated bridge including a deck and a plurality of girders extending in a spanwise direction along the prefabricated bridge, wherein the deck is supported above the plurality of girders; providing first and second steel abutments, each abutment including a beam and a bottom plate, the beam including an upper flange, a lower flange, and a web connecting the upper flange and lower flange, wherein the bottom plate is at a bottom surface of the lower flange and has a width that is at least 1.5 times as great as a width of the lower flange; placing the first steel abutment on a first side of an obstruction and the second steel abutment on a second side of the obstruction; placing the prefabricated bridge on the first and second steel abutments such that the first and second steel abutments extend underneath the plurality of girders in a direction transverse to the spanwise direction; and securing the prefabricated bridge to the first and second steel abutments.

In some aspects, each of the first and second steel of abutments further includes a plurality of stiffeners, with each stiffener interconnecting the upper flange of the beam to the bottom plate. The stiffeners are spaced apart along a length of the beam, wherein the plurality of stiffeners includes one or more stiffeners at intermediate points along the length of the beam. Accordingly, the method can further include placing the prefabricated bridge on the first and second steel abutments by aligning the girders of the prefabricated bridge with the intermediate stiffeners of the first and second steel abutments and then mounting the prefabricated bridge on the first and second steel abutments.

The details of one or more embodiments are set forth in the accompanying drawings and the description below. Other features, objects, and advantages will be apparent from the description and drawings, and from the claims.

DETAILED DESCRIPTION

Figure 1:
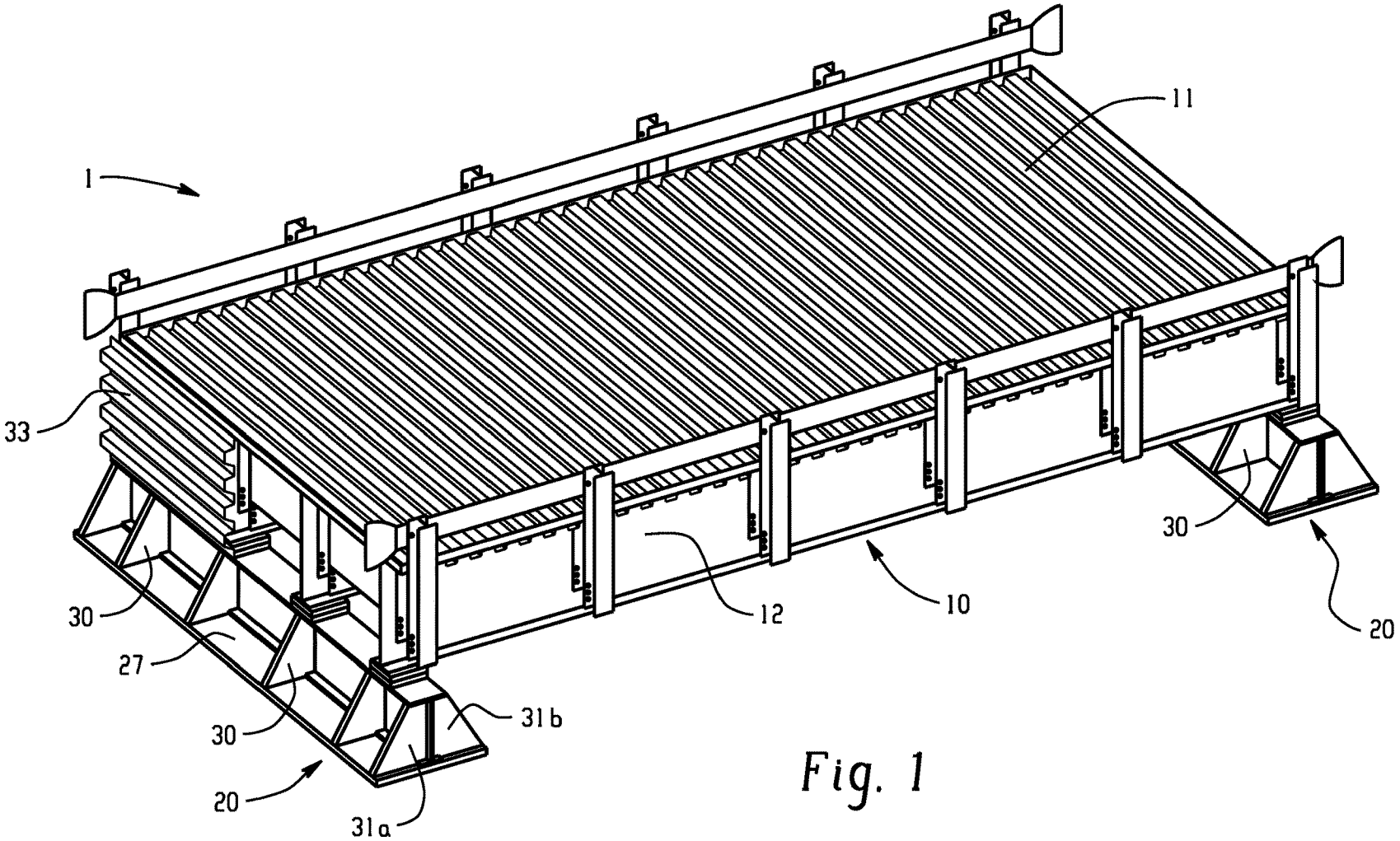
FIG. 1 is a perspective view of one embodiment of a supported bridge.
Figure 2:
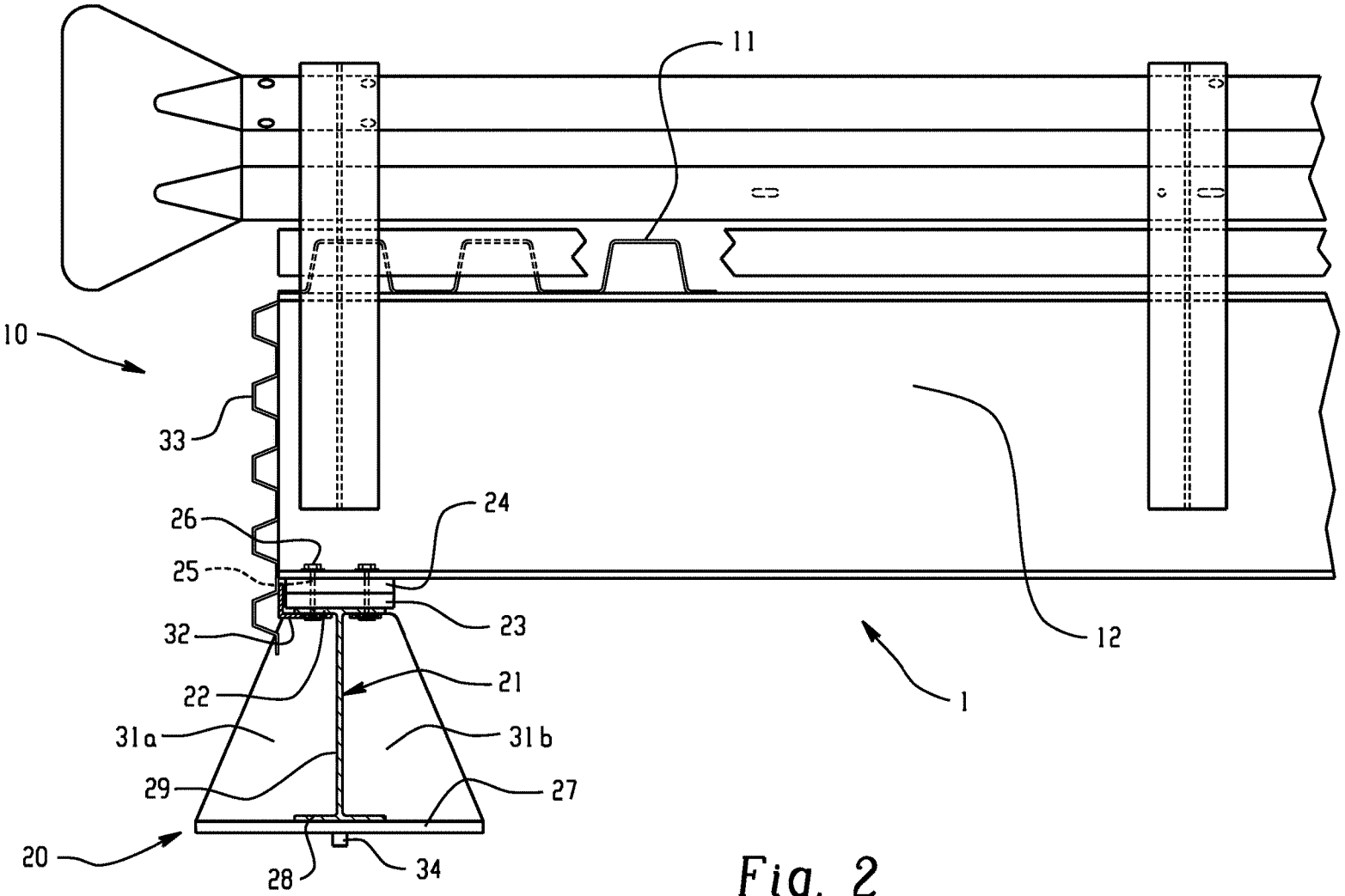
FIG. 2 is an side view of one embodiment of a supported bridge.
Figure 3:
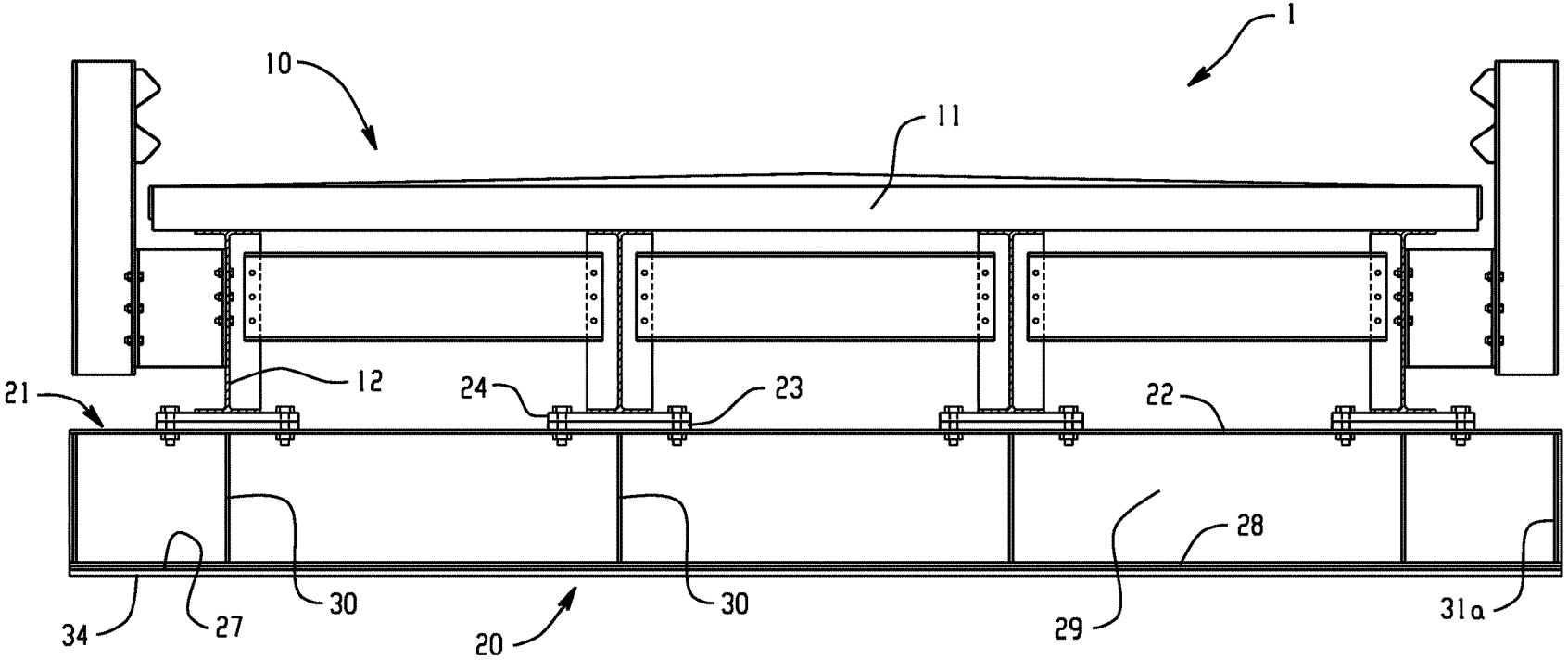
FIG. 3 is a end view of one embodiment of a supported bridge.

Referring to FIGS. 1-3, an exemplary supported bridge 1 is shown. The supported bridge 1 includes a bridge 10 and first and second steel abutments 20. The first and second steel abutments 20 can serve as a supporting foundation for the bridge 10. The steel abutments 20 extend in a direction transverse to the spanwise direction of bridge 10. Further, as shown in FIG. 1, the first and second steel abutments 20 are located at the two opposite ends of bridge 10; however, other configurations are possible. For example, the steel abutments can be located near the two opposite ends of bridge 10 but not at the ends of the bridge.

Referring to FIGS. 1-3, the bridge includes a deck 11. The bridge also includes a plurality of girders 12, which can be I-beams, as illustrated in FIGS. 1-3. The girders can extend in a spanwise direction along the supported bridge, as shown in FIG. 1. Further, the girders can be steel (e.g., galvanized steel). The deck 11 can be placed directly on, and secured to, the girders 12, as illustrated in FIGS. 1-3.

Figure 4:
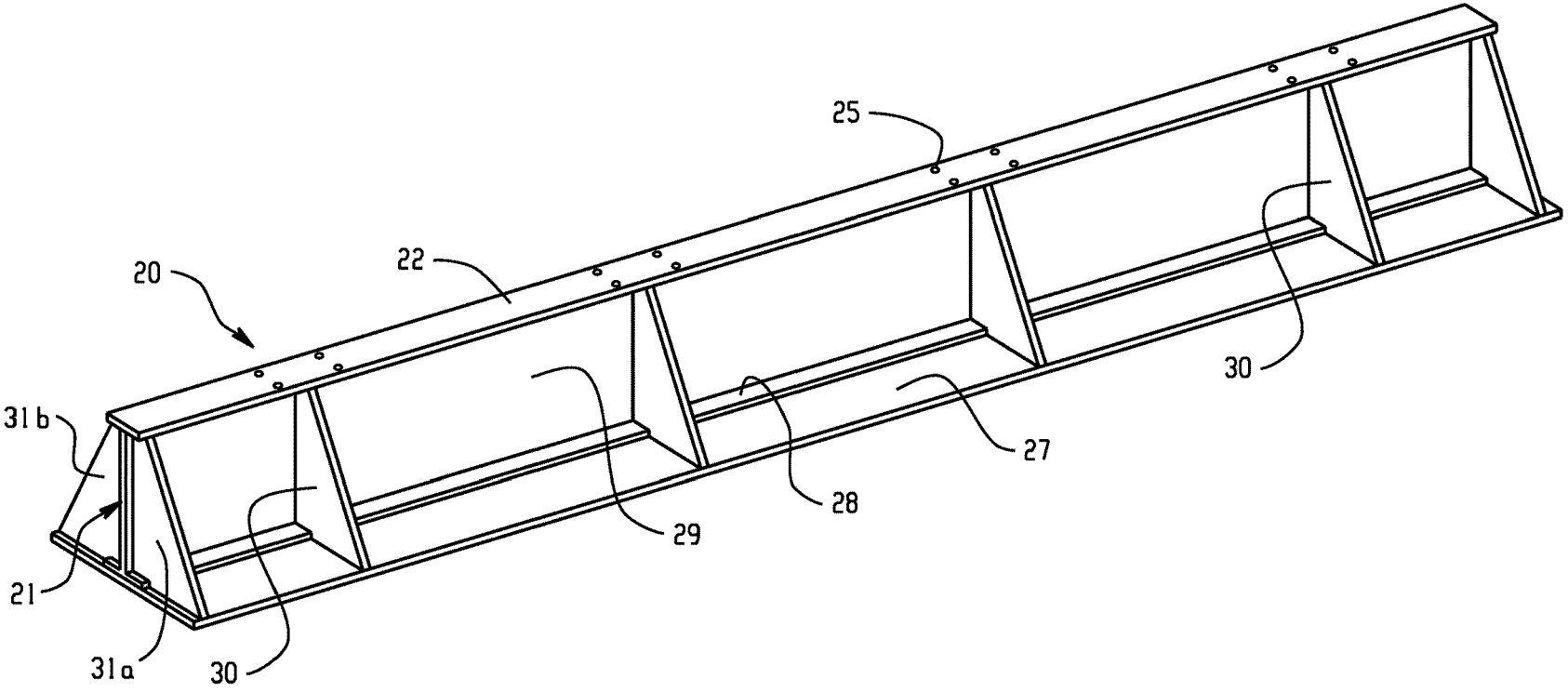
FIG. 4 is a perspective view of one embodiment of a steel abutment.

The girders 12 are designed to be mounted on top of, and be secured to, the first and second steel abutments 20. The steel abutments 20 include I-beam 21. I-beam 21 includes upper flange 22, bottom flange 28, and web 29 connecting the upper flange and lower flange, as illustrated in FIGS. 2-4. Further, the I-beam can be steel (e.g., galvanized steel).

The girders 12 can be mounted on top of the upper flange 22 of the steel I-beams 21, as illustrated in FIGS. 2-3. One or more mounting plates (e.g., shims or bearing pads) can be placed between the upper flange 22 of the I-beam and the girders 12, as shown in FIGS. 2-3, which depicts two mounting plates, 23 and 24, between the upper flange 22 and girder 12. The girders can be mounted on the one or more mounting plates and are secured thereon, for example, by welding. The one or more mounting plates can have matching fastener holes with the upper flange, allowing the girders to be securely held in place by bolting the one or more mounting plates with bolts to the upper flange of the I-beam. For example, as illustrated in FIG. 2, two mounting plates, lower mounting plate 23 and upper mounting plate 24, and upper flange 22, have matching fastener holes 25, allowing girder 12 to be securely held in place by bolting the two mounting plates with bolts 26 to the upper flange 22 of I-beam 21 and girder 12. The fastener holes 25 of I-beam 21 are also depicted in FIG. 4. Lower mounting plate 23 can also be welded to the upper flange 22 of I-beam 21. The upper mounting plate 24 can be welded to girder 12. Furthermore, the one or more mounting plates can have a width that is equal to the width of the top surface of the upper flange of the I-beam of the abutment and a length that is equal to or greater than the width of the girder.

Referring again to FIGS. 1-4, steel abutments 20 also include a bottom plate 27 that is mounted on the bottom surface of bottom flange 28. The bottom plate can be steel (e.g., galvanized steel). The longitudinal axis of bottom plate 27 is directly below the web 29 of I-beam 21 and the bottom plate is secured to the bottom surface of the bottom flange 28. For example, bottom plate 27 can be centered on bottom flange 28 and welded to the bottom surface of the bottom flange. The length of the bottom plate can equal the length of the I-beam, as illustrated in FIG. 3-4, or the bottom plate can be longer or shorter in length than the I-beam. Bottom plate 27 can have a width that is greater than the width of the bottom flange 28, as illustrated in FIGS. 2 and 4. In some aspects, the ratio of the width of the bottom plate to the width of the bottom flange can be between about 1.5:1 to about 5:1 or between about 2:1 to about 4:1. In some aspects, the ratio of the width of the bottom plate to the width of the bottom flange is about 3:1. In certain aspects, the ratio of the width of the bottom plate to the width of the bottom flange is about 1.5:1.

FIGS. 1 and 3-4 show internal transverse stiffeners 30 and end transverse stiffeners 31*a* and 31*b*. The stiffeners can function to prevent the I-beam from bending relative to the bottom plate and also can prevent the web of the I-beam from yielding, crippling and/or buckling. The stiffeners can be steel (e.g., galvanized steel). As can be seen in FIG. 3, the internal transvers stiffeners 30 can be spaced-apart and can be positioned below the girders 12 of the bridge such that the intermediate stiffeners are vertically aligned with girders. Further, the intermediate stiffeners can be vertically beneath a connection zone between the girder and the steel abutment, where the connection zone includes the area defined by lower mounting plate 23, upper mounting plate 24, and the corresponding girder 12 that upper mounting plate 24 is secured to. The end stiffeners 31*a* and 31*b* are positioned at, or near, opposite ends of I-beam 21 and the end stiffeners are aligned vertically with the intermediate stiffeners 30 and are perpendicular to the top surface of the bottom plate 27.

9As can be seen in FIGS. 1, 2, and 4, corresponding stiffeners 31*a* and 31*b* are placed on opposite sides of I-beam 21. Each stiffener 31*a* and 31*b* has an inner side edge having a surface that is in continuous contact with the surface of web 29, an upper side edge having a surface that is in continuous contact with the bottom surface of upper flange 22, and can have a bottom side edge having a surface that is in continuous contact with the top surface of bottom flange 28. Although not shown in FIGS. 2-4, intermediate stiffeners are placed on corresponding sides of the abutment I-beam, in a similar fashion as the end stiffeners. Further, the stiffeners (e.g. stiffeners 30, 31*a*, and 31*b*) can be welded (e.g. corner welded) to I-beam 21.

Referring again to FIGS. 2-3, each abutment 20 further includes a keel 34. The keel can serve to provide longitudinal stability. For example, the keel can prevent sliding. Keel 34 is secured to the bottom surface of bottom plate 27 and the keel extends longitudinally along the bottom plate. The keel can be steel (e.g., galvanized steel). As shown in FIG. 3, keel 34 is located directly below the web 29 of I-beam 21 and has a length that is equal to the length of the bottom plate; however, the keel can also have a length that is greater than or shorter than the length of the bottom plate. Further, keel 34 is secured to bottom plate 27, for example, by welding. Furthermore, the keel can be rectangular, as shown in FIG. 2. The width of the keel can vary, but in embodiments the keel has a width that is less than 1/10 the width of the bottom plate (e.g., less than 1/15 the width of the bottom plate).

As can be seen in FIG. 2, the supported bridge can also include closure angles 32. The closure angles can provide stability for the decking edge closure 33. The closure angles can also prevent the flange of I-beam 21 from damaging decking edge closure 33. As shown in FIG. 2, the decking edge closure can have a height that is greater than the height of girder 12. The decking end closure can also have a width equal to that of the deck and can be secured to the deck. The decking closure 33 in FIG. 1 covers half of a spanwise end of bridge 1; however, it is to be understood that the decking end closure can cover the entire spanwise end of bridge 1. Additionally, decking end closures can be placed on both spanwise ends of bridge 1. The decking closures can prevent debris, such as dirt and rocks, from entering into the space below bridge 1.

It is to be clearly understood that the above description is intended by way of illustration and example only, is not intended to be taken by way of limitation, and that other changes and modifications are possible. For example, in some implementations multiple stiffeners can be placed at the same intermediate point on the abutment. In such implementations, the stiffeners can be placed flush against each other. For example, in some implementations, three stiffeners can be place at the same intermediate point directly under a girder. In some implementations, the supported bridge includes more than two abutments, such as three, four, or six transverse abutments. In some implementations, all components of the transverse steel abutments are steel (e.g., galvanized steel). In some implementations, the I-beam, bottom plate, stiffeners, and keel of the transverse abutments are steel (e.g. galvanized steel). In other implementations the beam of the steel abutments could be of a different shape than I-beam, such as a C-channel beam with upper and lower flanges extending to only one side the web that interconnects the upper and lower flanges.

What is claimed is:

1. A supported bridge, comprising:

a prefabricated bridge including a deck and a plurality of girders extending in a spanwise direction along the supported bridge, wherein the deck is supported above the plurality of girders; and first and second steel abutments extending underneath the plurality of girders in a direction transverse to the spanwise direction, each of the first and second steel abutments including an I-beam and a bottom plate, the I-beam including an upper flange, a lower flange, and a web connecting the upper flange and lower flange, wherein the bottom plate is mounted at a bottom surface of the lower flange and has a width that is at least 1.5 times as great as a width of the lower flange, wherein the first steel abutment is located toward a first end of the prefabricated bridge and the second steel abutment is located toward a second end of the prefabricated bridge.

2. The supported bridge of claim 1, wherein the girders are I-beam girders, each I-beam girder having an upper flange, a lower flange, and an interconnecting web, wherein the upper flange of each I-beam girder supports the bridge deck and the bottom flange of each I-beam girder is supported on the first and second steel abutments.

3. The supported bridge of claim 1, wherein, in each steel abutment, the bottom plate has a length that is substantially the same as, or greater than, a length of the I-beam.

4. The supported bridge of claim 1, wherein each steel abutment further includes a plurality of stiffeners, each stiffener interconnecting the upper flange of the I-beam to the bottom plate, the stiffeners spaced apart along a length of the I-beam.

5. The supported bridge of claim 4, wherein, in each steel abutment, the plurality of stiffeners include at least first and second end stiffeners at opposite ends of the steel abutment.

6. The supported bridge of claim 5, wherein, in each steel abutment, the plurality of stiffeners further include one or more intermediate stiffeners at intermediate points along the length of the I-beam.

7. The supported bridge of claim 6, wherein each steel abutment includes at least one intermediate stiffener aligned with each girder.

8. The supported bridge of claim 6, wherein each of the one or more intermediate stiffeners is vertically beneath a connection zone between the girder and the steel abutment.

9. The supported bridge of claim 8, wherein the girders are I-beam girders, and each of the at least one intermediate stiffeners is of substantially planar plate configuration that is aligned with a plane defined by a web of the girder.

10. The supported bridge of claim 1, wherein each of the first and second steel abutments further includes a keel extending lengthwise along a bottom surface of the bottom plate.

11. The supported bridge of claim 1, wherein one or more mount plates are placed between the girders and the upper flanges of the I-beams.

12. The supported bridge of claim 1, wherein, as to each girder:

a first end of the girder is mounted to the first steel abutment by a first connection arrangement and a second end of the girder is mounted to the second steel abutment by a second connection arrangement, the first connection arrangement includes a first upper mount plate connected to an underside of the girder, a first lower mount plate connected to the upper flange of the first steel abutment and a plurality of bolts passing through aligned holes of the first upper mount plate and the second lower mount plate, and the second connection arrangement includes a second upper mount plate connected to the underside of the girder, a second lower mount plate connected to the upper flange of the second steel abutment and a plurality of bolts passing through aligned holes of the second upper mount plate and the second lower mount plate.

13. The supported bridge of claim 1, wherein, as to each girder:

the first upper mount plate is welded to the girder and the first lower mount plate is welded to the upper flange of the first steel abutment, and the second upper mount plate is welded to the girder and the second lower mount plate is welded to the upper flange of the second steel abutment.

14. A supported bridge, comprising:

a prefabricated bridge including a deck supported by a plurality of steel girders extending in a spanwise direction along the supported bridge, wherein the deck is supported above the plurality of girders; and first and second steel abutments extending underneath the plurality of girders in a direction transverse to the spanwise direction, wherein the first steel abutment is located toward a first end of the prefabricated bridge and the second steel abutment is located toward a second end of the prefabricated bridge, each abutment including a beam and a bottom plate, the beam including an upper flange, a lower flange, and a web connecting the upper flange and lower flange, wherein the bottom plate is mounted at a bottom surface of the lower flange and has a width that is at least 1.5 times as great as a width of the lower flange, the first steel abutment includes a stiffener toward each end and one or more intermediate stiffeners located at intermediate points along the length of the first steel abutment, wherein at least one intermediate stiffener is vertically beneath a connection zone between one girder and the first steel abutment, and the second steel abutment includes a stiffener toward each end and one or more intermediate stiffeners located at intermediate points along the length of the second steel abutment, wherein at least one intermediate stiffener is vertically beneath a connection zone between one girder and the second steel abutment.

15. The supported bridge of claim 14 wherein the first steel abutment further includes a keel extending lengthwise along a bottom surface of the bottom plate of the first steel abutment; and the second steel abutment further includes a keel extending lengthwise along a bottom surface of the bottom plate of the second steel abutment.

16. The supported bridge of claim 15 wherein a width of the keel of the first steel abutment is less than 1/10 the width of the bottom plate of the first steel abutment, and a width of the keel of the second steel abutment is less than 1/10 the width of the bottom plate of the second steel abutment.

* * * * *